US011466920B2

(12) United States Patent
Hanna

(10) Patent No.: US 11,466,920 B2
(45) Date of Patent: Oct. 11, 2022

(54) ICE CHEST ORGANIZER SYSTEM

(71) Applicant: Stacey Hanna, Incline Village, NV (US)

(72) Inventor: Stacey Hanna, Incline Village, NV (US)

( * ) Notice: Subject to any disclaimer, the term of this patent is extended or adjusted under 35 U.S.C. 154(b) by 246 days.

(21) Appl. No.: 16/396,672

(22) Filed: Apr. 27, 2019

(65) Prior Publication Data

US 2019/0353416 A1 Nov. 21, 2019

Related U.S. Application Data

(60) Provisional application No. 62/732,544, filed on Sep. 17, 2018, provisional application No. 62/663,717, filed on Apr. 27, 2018.

(51) Int. Cl.
*B65D 81/38* (2006.01)
*F25D 3/08* (2006.01)

(52) U.S. Cl.
CPC ..... *F25D 3/08* (2013.01); *B65D 81/38* (2013.01); *B65D 81/3825* (2013.01)

(58) Field of Classification Search
CPC ..... B65D 81/3825; B65D 81/38; B65D 21/0233; B65D 81/383; B65D 81/3834; B65D 25/04; B65D 25/14; B65D 25/10
USPC ..... 220/592.23, 23.88, 23.83, 571, 23.9
See application file for complete search history.

(56) References Cited

U.S. PATENT DOCUMENTS

| | | | | | |
|---|---|---|---|---|---|
| 3,052,508 | A * | 9/1962 | Fink | F25D 13/02 | 312/404 |
| 3,241,706 | A * | 3/1966 | Monaco | A47J 27/10 | 206/558 |
| 3,743,372 | A * | 7/1973 | Ruggerone | A47B 87/02 | 312/108 |
| 5,454,478 | A * | 10/1995 | Everson | A45C 13/02 | 220/23.83 |
| 2007/0051728 | A1* | 3/2007 | Bazany | B65D 25/04 | 220/529 |
| 2007/0257587 | A1* | 11/2007 | Jackson | A47B 67/04 | 312/330.1 |
| 2011/0073515 | A1* | 3/2011 | Tai | B65D 21/0233 | 206/505 |
| 2014/0103058 | A1* | 4/2014 | Schiering | B65D 83/0805 | 221/34 |
| 2014/0265802 | A1* | 9/2014 | Wilcox | F25D 25/025 | 312/404 |

* cited by examiner

*Primary Examiner* — Stephen J Castellano
(74) *Attorney, Agent, or Firm* — ATIP Law; Ian Burns

(57) ABSTRACT

An organizer system for an ice cooler, ice chest or the like includes multiple trays of different heights that can be supported within a body of the ice cooler. The trays having different heights define multiple height compartments within the ice cooler, thereby enable different items such as cans, bottles, etc., to be stored with enhanced space efficiency. The trays each have dividing walls that define handles thereby enabling the trays to be removed from the ice cooler. The trays may be supported by a shelf within the ice cooler, or by an additional insert provided in the cooler. The insert may have sidewalls that abut the walls of the ice cooler. Cutouts may be provided in the insert sidewalls to enable drainage. The trays may also have openings for allowing cool air to circulate and to allow liquids to drain out of the trays. The openings may be positioned on the walls, bottom or both.

9 Claims, 12 Drawing Sheets

ICE CHEST ORGANIZER SYSTEM

CROSS REFERENCE TO RELATED APPLICATIONS

This application claims priority to U.S. provisional patent application Ser. Nos. 62/663,717 filed 27 Apr. 2018 and 62/732,544 filed 17 Sep. 2018, the contents of each of which are herein incorporated by reference.

FIELD OF THE INVENTION

The present invention relates to a system for organizing and supporting items in a cooler or ice chest. More specifically, the present invention relates to a system for providing removable tray(s) with a cooler, permitting the organization and segregation of various items within the cooler.

BACKGROUND

Cooler and ice chests are known in the art.

However; there have long been many difficulties associated with packing and organizing items in ice chests. For example, when ice is used in an ice chest, the ice eventually melts and water collects in the bottom of the chest. This water can damage items that are sensitive to moisture or are not packaged appropriately. Therefore, it is desirable to pack some items at the top of the chest where they are less likely to be damaged by water. It is also desirable to have easier access to some items relative to other items. For instance, one may wish to access drinks more frequently than food. In this case, it is advantageous to place drinks at the top of the ice chest. When packing the ice chest, it is also very desirable to avoid damage that can occur when items contact each other in the ice chest. For example, it is usually better to place soft or fragile items above and separate from hard and heavy items.

What is required is an ice chest insert system for organizing the contents within an ice chest.

SUMMARY OF ONE OR MORE EMBODIMENTS OF THE INVENTION

Advantages of One or More Embodiments of the Present Invention

The various embodiments of the present invention may, but do not necessarily, achieve one or more of the following advantages.

First, the ability to segregate items of different heights in the cooler, such as cans and bottles, but not limited to such.

Second, the ability to drain water through organizer elements within the cooler.

Third, the ability to place trays with handles inside the cooler liner wherein the trays have a lip that would rest on an edge located about the perimeter of the top of the liner insert.

The ability to place trays with handles inside the cooler where the bottom of the trays rest on a ring that matches the height of the trays.

The ability to organize the internal body of a cavity to sections or compartments of different heights to account for different sized items.

These and other advantages may be realized by reference to the remaining portions of the specification, claims, and abstract.

Brief Description of One or More Embodiments of the Present Invention

In one embodiment, there is cooler liner that would fit snugly inside a cooler. The cooler liner includes an edge pointing inward about the top interior perimeter of the cooler liner. The edge is designed to support trays of different heights inside the cooler liner that abuts the interior cooler sidewalls. Ice is placed in the bottom of the cooler liner, and there is an opening through the liner that permits melted ice to be discharged by an inwardly protruding drain to an external spout that is often found on the bottom exterior of many coolers.

In one aspect, there is provided an ice cooler having a body defining an internal cavity defined by an internal sidewall. A first organizer tray having a first height and a second organizer tray having a second height may be supported in side by side relationship within the internal cavity. One or both of the organizer trays may comprise a vertical divider that divides the respective tray into at least two compartments. A handle may be formed in the vertical divider.

In one aspect, there is provided an organizer system for an ice cooler, ice chest or the like. A first organizer tray having a first height and a second organizer tray having a second height different to the first height are configured to be arranged in side by side relationship. The first organizer tray and the second organizer tray may each comprise a vertical divider that divides the respective tray into at least two compartments. A handle may be formed in the vertical divider that enables the respective tray to be removed from the ice cooler.

In one aspect, there is provided an organizer system for an ice cooler, ice chest, or the like. The organizer system may include first organizer means defining a first tray having a first height. The first organizer means may include first divider means within the first organizer means, the first divider means comprising first handle means for allowing the first organizer means to be removed from an ice cooler. The organizer system may include second organizer means defining a second tray having a second height. Second divider means within the second organizer means may comprise second handle means for allowing the second organizer means to be removed from the ice cooler.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

As noted above, what is required is a system that can be used for organizing the contents of an ice chest or similar cooler. To this end, there is described herein an organizer system for use in an ice chest, cooler etc. Multiple trays of the organizer can be placed within the opening of the ice chest and divides the chest cavity into multiple compartments of different heights. The trays may rest on a shelf or lip within the cooler if the cooler is provided with such. Alternatively, an additional insert may be provided to provide a support for the trays. The insert may include one or more walls that have an opening to allow ice melt or other liquids to drain out of the insert to a drain of the cooler. As the trays have different heights, soda cans, for example, may be placed in a first tray with a lesser height whereby larger soda bottles may be placed in a second tray with a greater height. Different sized compartments are also created under the trays by the organizer system. Although the instant invention could segregate soda bottles and soda cans, it is not to be limited to this use. The insert and trays may be manufactured from injection molded plastic or other materials with similar mechanical properties. This permits the insert and trays to be manufactured inexpensively. Additionally, injection molded plastic is lightweight and durable. The insert may be easily cleaned with soap and water or other surfactants. The insert and trays are waterproof and may add additional insulation about the ice.

Figure 1:
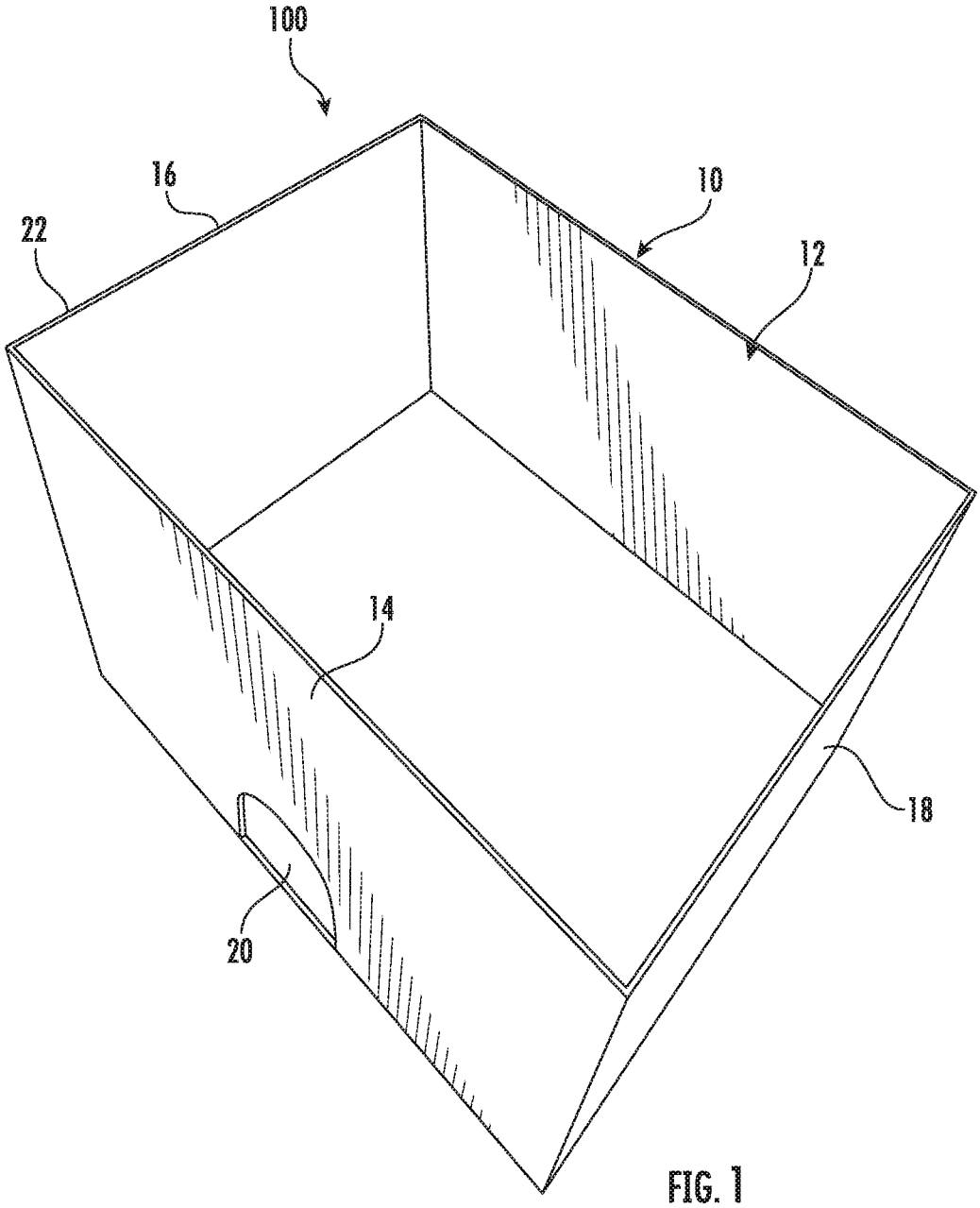
FIG. 1 is substantially a perspective view of the ice chest organizer system.

Referring specifically to FIGS. 1-6, a first embodiment of the cooler liner or insert 10 is shown. FIG. 1 shows a cardboard mock-up of the cooler liner or insert 10. The cooler liner 10 is designed to be made from a waterproof material such as, but not limited to, injection molded plastic. Cooler liner 10 is of a size and shape to be placed inside of the cooler. The plastic (or other material) would need to have sufficiently robust material properties that would permit the cooler liner 10 to stand in the cooler and to support a first tray 40 and a second tray 50. The cooler liner has four sidewalls (12, 14, 16, 18). When placed inside of a cooler, sidewalls (12, 14, 16, 18) may abut the inner sidewalls of the cooler. An opening 20 is located on sidewall 14 to allow water from melted ice to exit through an inwardly protruding drain located in the cooler (not shown). This drain often connects to an external spout that is often found on the bottom outside of the cooler (not shown). About the interior of the four sidewalls (12, 14, 16, 18) is an inwardly pointing edge 64 (best seen in FIG. 6). While a single drain aperture 20 is shown in one sidewall only, multiple apertures 20 may be provided in multiple sidewalls.

Figure 2:
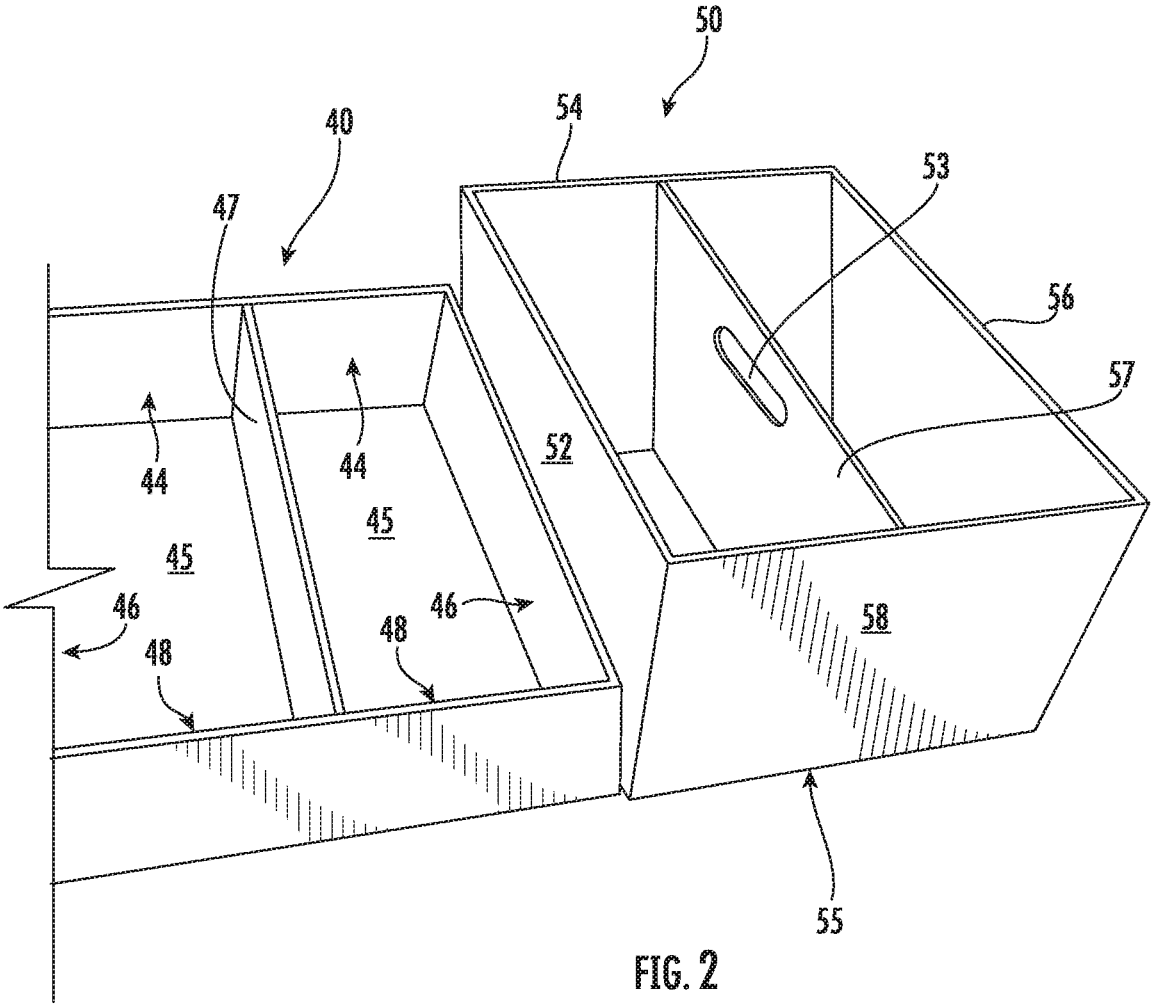
FIG. 2 is substantially a perspective view of the trays employed with the ice chest organizer system.

Referring now to FIG. 2, the first organizer tray 40 and the second organizer tray 50 are shown. The first tray 40 has a first height and the second tray 50 has a second height. The first tray 40 has four sidewalls (42, 44, 46, 48) a bottom wall 45, and a dividing central wall 47. The dividing central wall 47 separates the first tray 40 into two rectangular sides of equal dimension and permits the organization of foodstuffs, drinks, samples, items and the like that may be placed in the first tray 40. The dividing central wall 47 also includes a handle 43 (best seen in FIG. 4) formed as an aperture in the dividing central wall 47. The first tray 40 bottom wall 45 would be adjacent to ice placed in the cooler insert 10.

The second tray 50 has four sidewalls (52, 54, 56, 58), a bottom wall 55, and a dividing central wall 57. The dividing central wall 57 separates the second tray 50 into two rectangular sides of equal dimension which permits the organization of foodstuffs, drinks, samples, items and the like that may be placed in the second tray 50. The dividing central wall 57 also includes an aperture that forms a handle 53. The second tray 50 bottom wall 55 would be adjacent to ice placed in the cooler insert 10.

Figure 3:
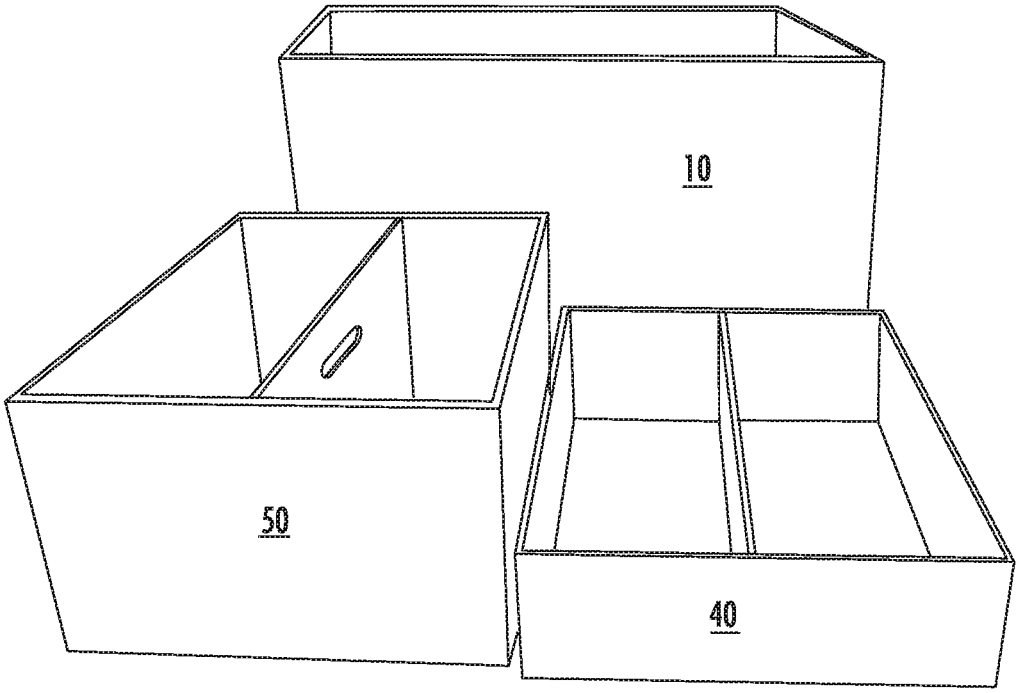
FIG. 3 is substantially a side perspective view of the ice chest organizer system including the insert and the two trays.

Referring now specifically to FIG. 3, the main components of the ice chest organizer system 100 that supports removable trays are shown. The cooler insert 10 is shown adjacent to the first tray 40 and the second tray 50. The cooler insert 10 is designed to be placed in a cooler. As the cooler insert 10 only has 4 sidewalls (12, 14, 16, 18), the cooler bottom (not shown) acts as a bottom for the cooler insert 10. This is where the ice would be placed, on the cooler bottom, where it would fill the areas below the first tray 40 and the second tray 50. As the ice melts, the water would exit through cooler inset 20, where it may be discharged from the cooler via the usual drain spout of the cooler. Other coolants such as dry ice may be used if desired. Dry ice would allow the cooler to keep items colder than conventional water ice.

Figure 4:
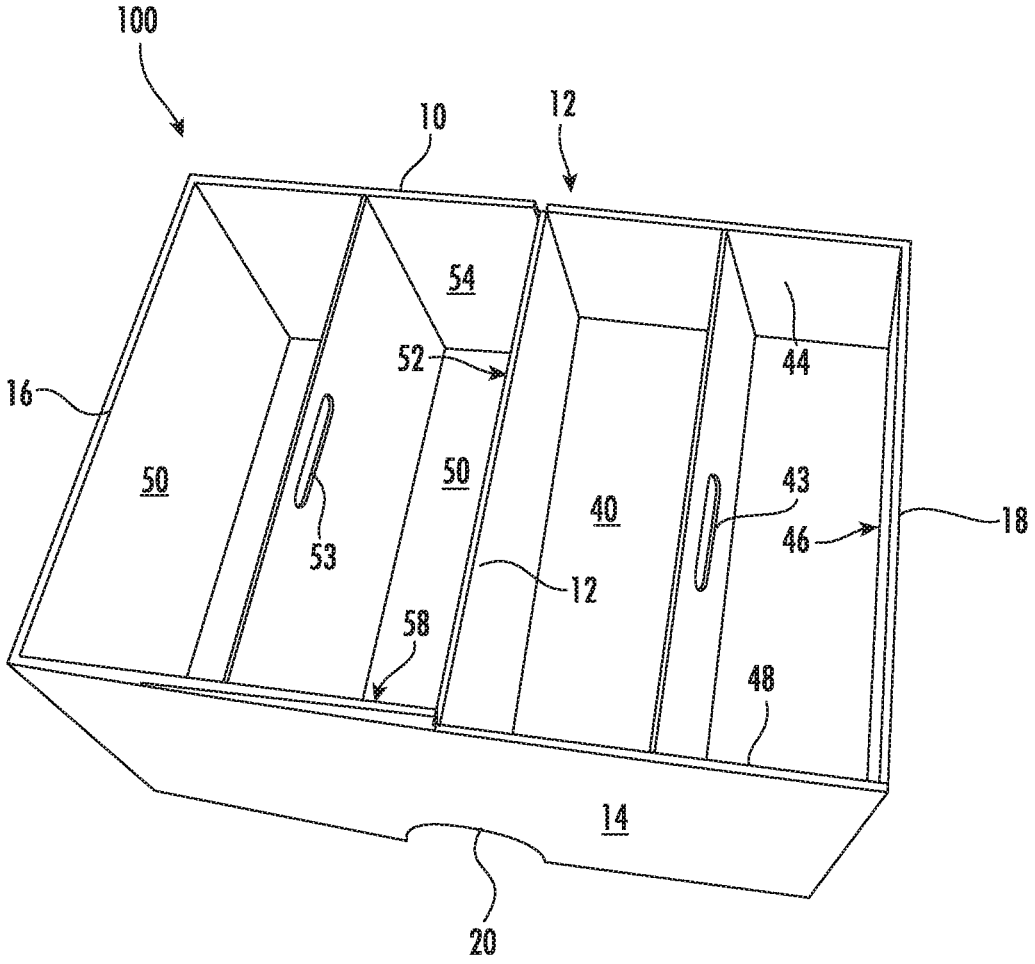
FIG. 4 is substantially a top view showing the ice chest organizer system with the insert supporting the two trays.

Referring now specifically to FIG. 4, a top view of the first tray 40 and the second tray 50 are shown inside the cooler insert 10. The cooler insert 10 is designed to be placed into a cooler (not shown). FIG. 4 shows a top view of the ice chest organizer system 100 as it would be when placed in a cooler.

Figure 5:
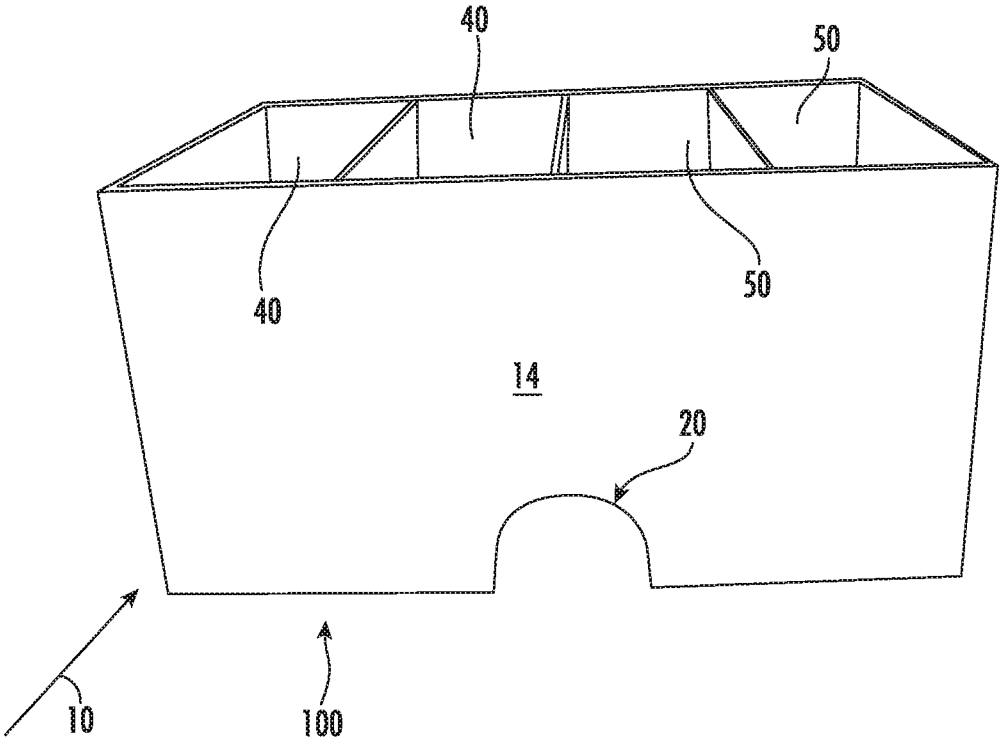
FIG. 5 is substantially a side view showing the ice chest organizer system.

Referring now specifically to FIG. 5, a side view of the first tray 40 and the second tray 50 are shown inside the cooler insert 10. FIG. 5 shows a top view of the ice chest organizer system 100 as it would be when placed in a cooler.

Figure 6:
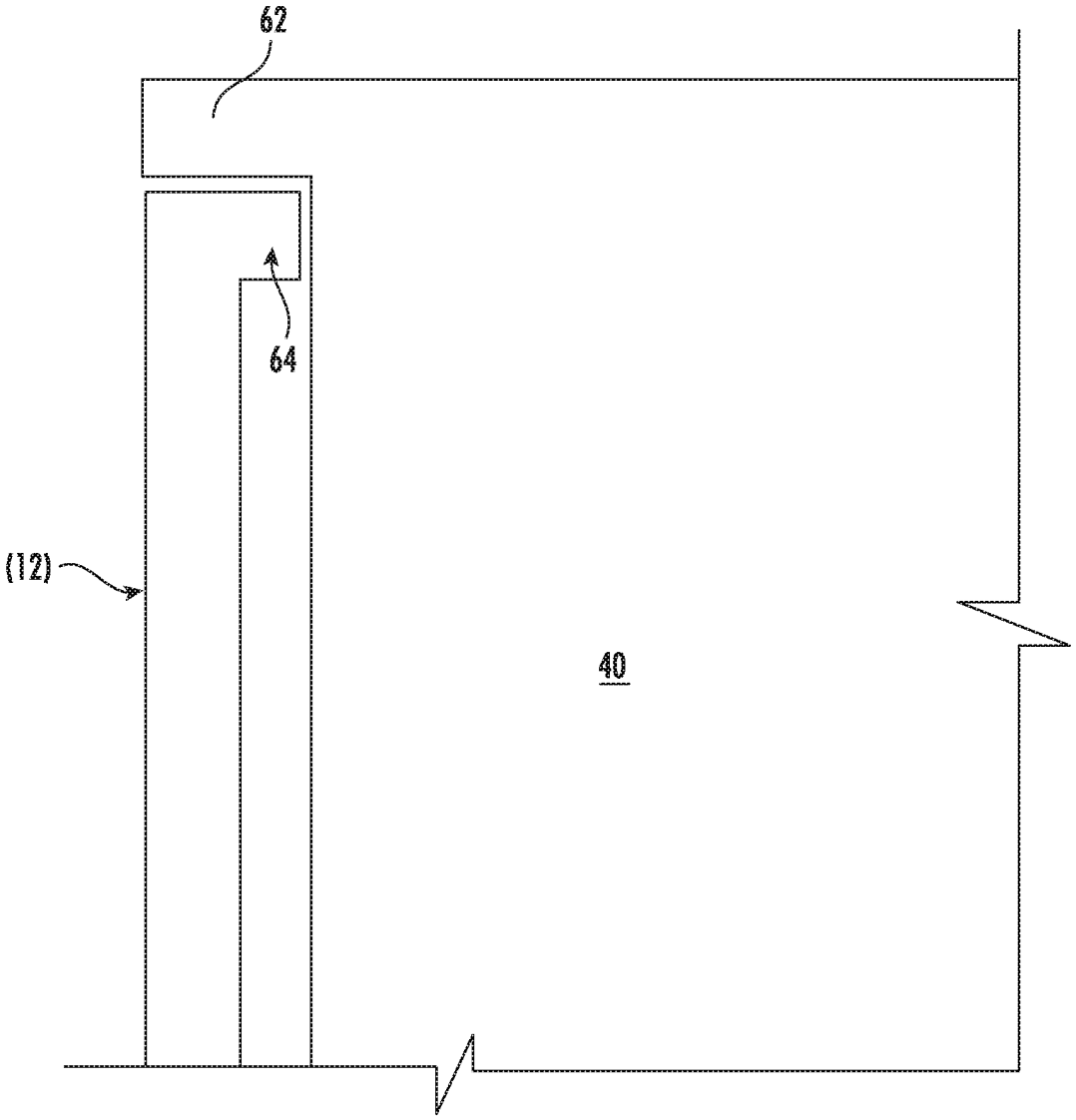
FIG. 6 is a cut-away view showing how the top edge of the organizer insert system will support the first tray and second tray.

Referring now to FIG. 6, a cutaway view of the top of the cooler insert 10 with the first tray 40 resting thereon is shown. The first tray 40 has a lip 62 which would lay atop the inwardly pointing edge 64 which is located about the perimeter of the cooler liner 10. The second tray 50 also has a lip 62 which would also rest atop the inwardly pointing edge 64. On the sides of the first tray 40 and the second tray 50 which intersect each other (sidewall 42 on tray 40 and sidewall 52 on tray 50, there may not be an inwardly pointed edge 64 so that the two trays (40, 50) can fit in the cooler liner 10. Alternatively, the inwardly pointed edge 64 could be present on sidewall 42 and sidewall 52, where they could be bent, removed or interleaved to fit into the cooler liner 10. Although first tray 40 is shown supported by the inwardly pointed edge 64, the same configuration exists for the support of second tray 50. Other means to support the first tray 40 and the second tray 50 have been contemplated, including, but not limited to, ring elements placed inside the cooler liner 10 at a depth that the first tray 40 and the second tray 50 would be able to be supported in the cooler insert 10. This ring structure may be a first height for the first tray 40 and a second height for the second tray 50 so that the two trays (40, 50) align as shown. FIG. 6 shows cooler insert 10 sidewall 12. The sidewall 12 may be replaced by sidewalls 14, 16 or 18 and would still show the same supporting structure of the inwardly pointing edge 64.

A further embodiment of the cooler assembly having internal trays at different depths forming compartments of different sizes is shown in FIGS. 7-12.

Figure 7:
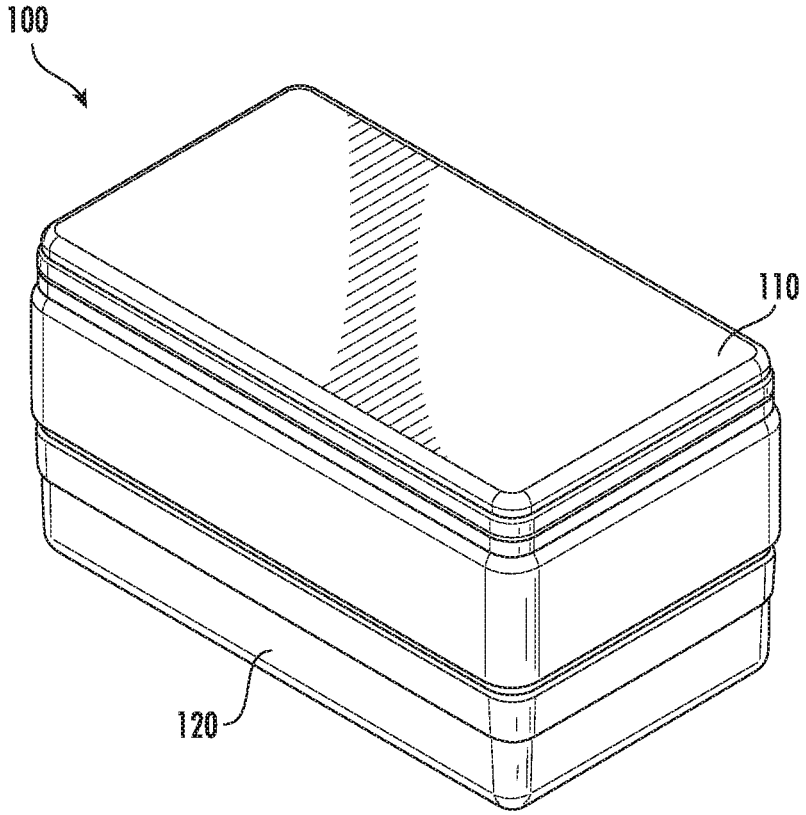
FIG. 7 is a perspective view of a further embodiment of the cooler assembly.

Referring specifically to FIG. 7 a perspective view of a further embodiment of the cooler assembly 100 is shown. The cooler assembly 100 includes a hinged lid 110 and a main outer body 120. The cooler outer body 120 may be comprised of any well known materials which possess the mechanical properties combined with the heat transfer characteristics required for cooler assemblies. The cooler assembly 100 is generally rectangular and may include an outer sidewall design including decorative curves and lines.

Figure 8:
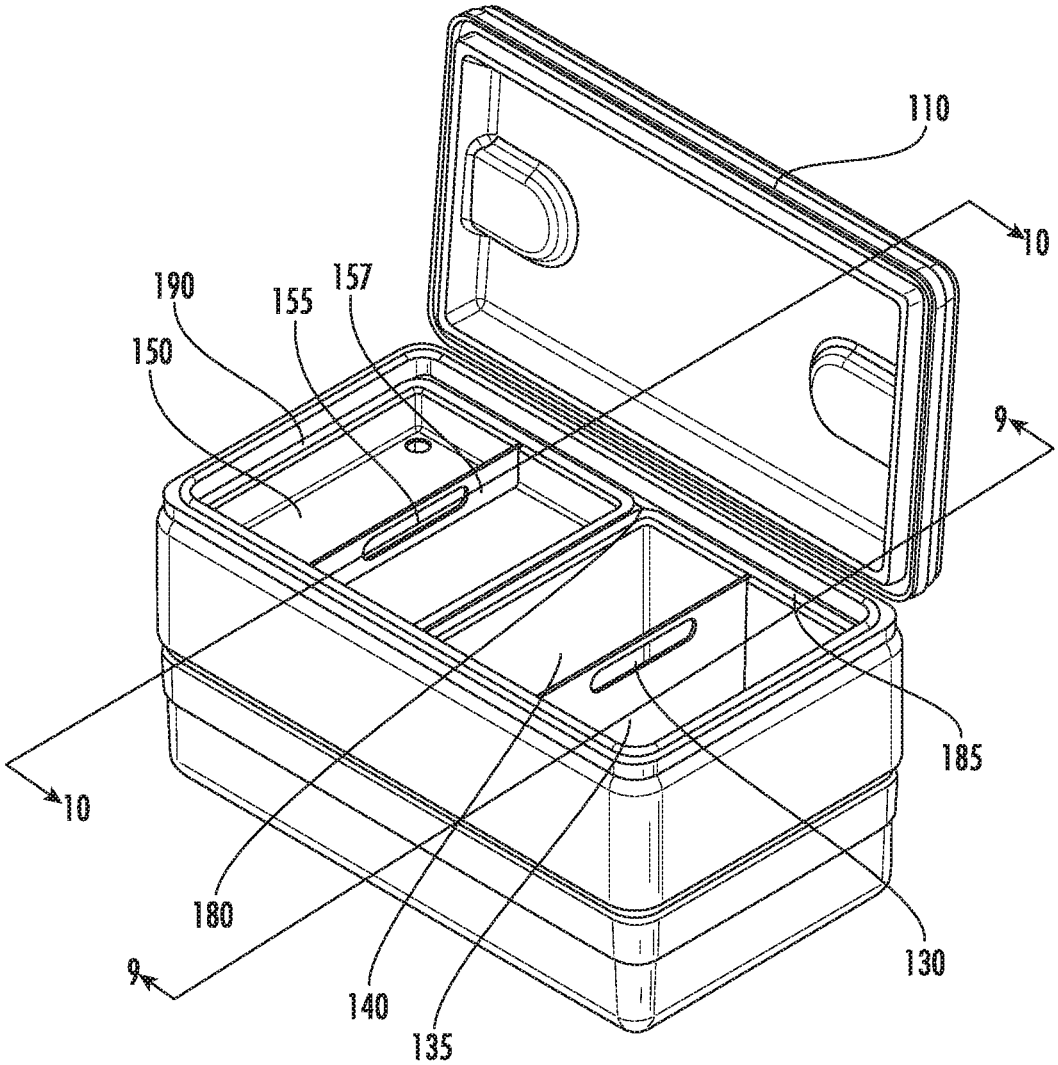
FIG. 8 is the cooler assembly with the lid open showing the top portion of the internal cooler elements and relative dimensions of the two adjacent trays.

FIG. 8 shows the cooler assembly 100 with the lid 110 open showing the top portion of the internal cooler elements and relative dimensions of the two adjacent trays, the deep tray 140 and the adjacent shallow tray 150, within the main body or cavity of the cooler 100. Although not well shown, surrounding the interior of the cooler assembly 100 proximal the top opening is a supporting shelf 180 extending inwardly from the top interior sidewalls of the cooler assembly 100. The first tray 140 includes a first outwardly facing small lip 185 extending about the perimeter of the first tray 140. The second tray 150 includes a second outwardly facing small lip 190 extending about the perimeter of the second tray 150. The first outwardly facing small lip 185 would rest atop the supporting shelf 180 of a first half of the cooler assembly 100. The second outwardly facing small lip 190 would rest atop the supporting shelf 185 of the second half of the cooler assembly 100. This configuration allows the first tray 140 to be adjacent to the second tray 150.

The first tray 140 has a first tray vertical separator 135 which separates the first tray 140 into two equal parts. Proximal the top of the first tray vertical separator 135 is a first tray handle 130 formed by an aperture in the vertical separator 135. The first tray 140 has two equal storage areas therein. Underneath the first tray 140 is a third storage area 200. Underneath the second tray 150 is a fourth storage area 210.

The second tray 150 has a second tray vertical separator 157 which separates the second tray 150 into two equal parts. Proximal the top of the second tray vertical separator 157 is an aperture that forms a second tray handle 155. The second tray 150 has two equal storage areas therein.

Figure 9:
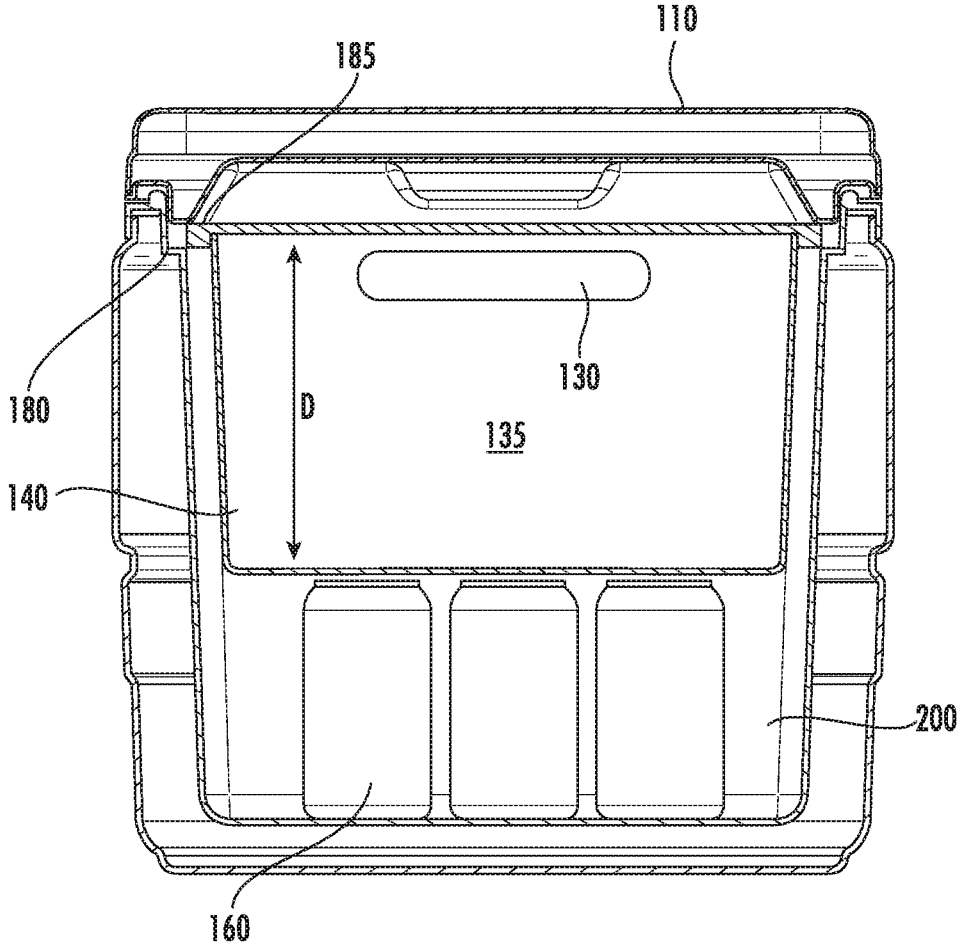
FIG. 9 is a cross-section view of the cooler assembly taken along line 9-9 of FIG. 8.

FIG. 9 shows a side view taken along line 9-9 of FIG. 8. This side view is taken along the first tray vertical separator 135 which has the central handle 130 on top which bifurcates the first tray 140. There is a second tray 150 adjacent to the first tray 140. First tray 140 has a greater depth than the second tray 150. First tray 140 has a depth D permitting the placement of standard 12 oz cans in a vertical orientation as shown, or other amount of cans underneath the first tray 140. The first tray 140 depth D may be chosen to be another depth. Although FIG. 9 does show cans 160, anything may be stored underneath of the first tray 140. Ice, food, can, bottles, containers, sandwiches, fruit or any other items may be stored underneath the first tray 140 as long as it fits in the first interior portion 200 of the cooler assembly 100 underneath the first tray 140. The interior portion of the cooler assembly 100 underneath the first tray 140 is which may alternatively be designated as a third storage area 200 in addition to the area beneath the first tray 140.

Figure 10:
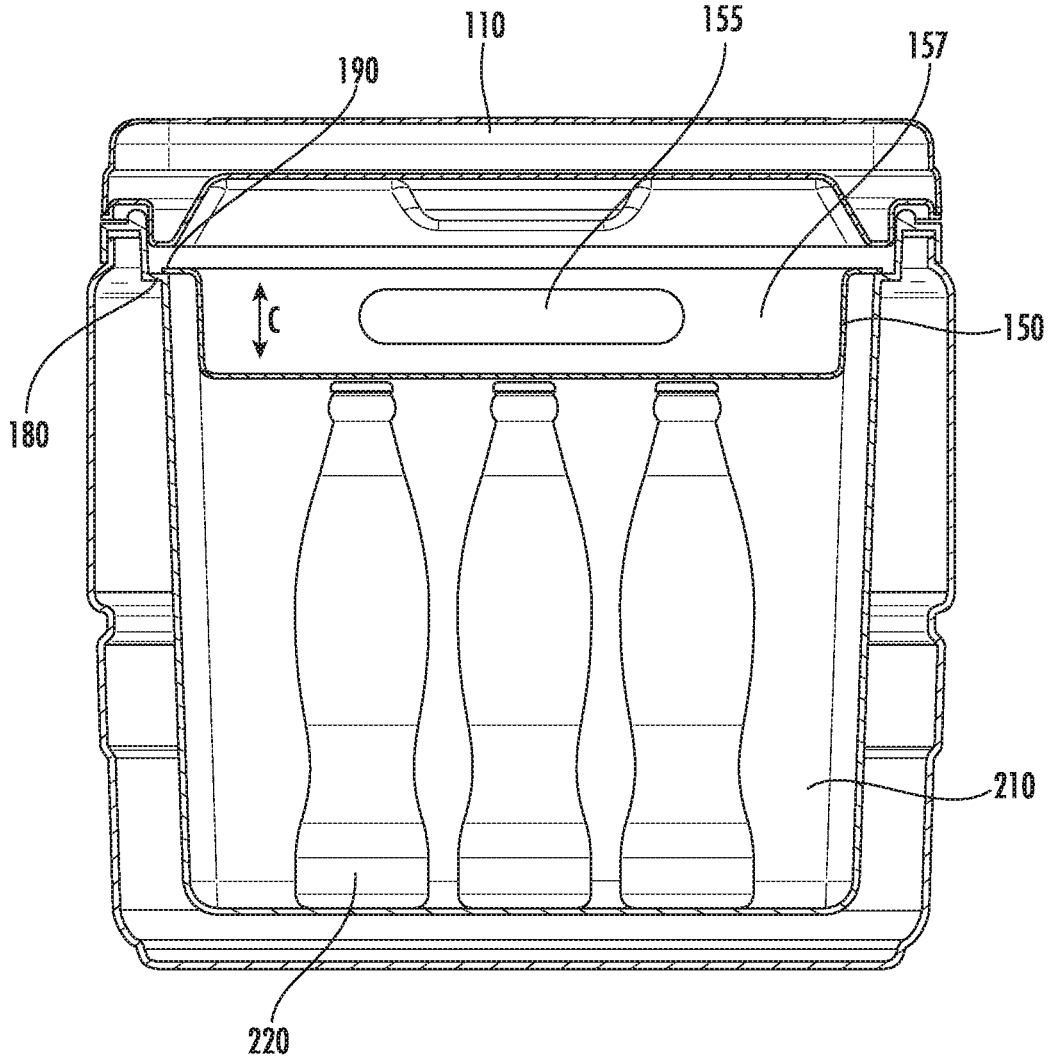
FIG. 10 is a cross section view taken along line 10-10 of FIG. 8.

FIG. 10 is a cross section view taken along line 10-10 of FIG. 8. This side view is taken along the second tray vertical separator 157 which has the central handle 155 on top which bifurcates the second tray 150 and into the fourth storage area 210 below the second tray 150. Second tray 150 has a depth C permitting the placement of standard bottles 220 underneath the second tray 150. The second tray 150 depth C may be chosen to be another depth. Although FIG. 10 does show bottles 220 anything may be stored underneath of the second tray 150. Ice, food, can, bottles, containers, sandwiches, fruit or any other items may be stored underneath the second tray 150 as long as it fits in the interior portion of the cooler assembly 100 underneath the second tray 150. The cooler assembly 100 underneath the second tray 150 may alternatively be designated as a fourth storage area 210 in addition to the fourth storage area 210.

Figure 11:
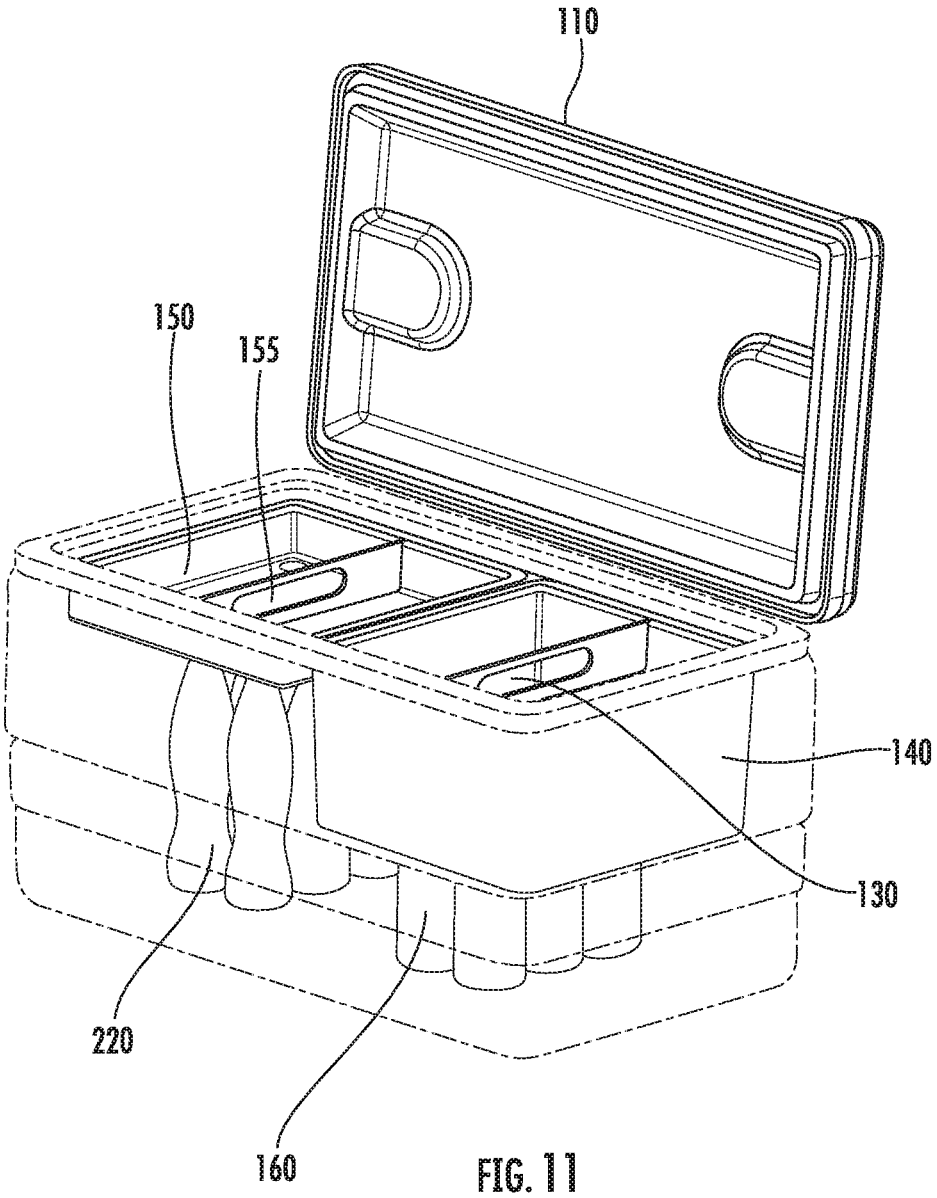
FIG. 11 is a transparent view of the cooler assembly, allowing the viewing of the internal configuration of interior elements of the cooler assembly.

FIG. 11 is a view of the cooler assembly 100 having imaginary transparent insulating walls, allowing the viewing of the internal configuration showing the positions of interior elements of the cooler assembly 100 including stored elements. The insulating walls of the cooler assembly 100 are not transparent, but are made from a plastic material which would have a low coefficient of heat transfer. Tray 140 has a height of D permitting a 6 pack of soda, other canned beverages, ice, food, other smaller cans, bottles, containers, sandwiches, fruit or any other items may be stored underneath the first tray 140 as long as it fits in the interior portion of the cooler assembly 100 underneath the first tray 140.

Second tray 150 has a height of C permitting a 6 pack of bottled soda, other bottled beverages, ice, food, other smaller cans, bottles, containers, sandwiches, fruit or any other items may be stored underneath the second tray 150 as long as it fits in the interior portion of the cooler assembly 100 underneath the second tray 150.

It can be seen that due to the configuration of the trays (140, 150), they can be reversed from the position which is shown in FIGS. 7-12, the consumer may place them on either side of the cooler assembly 100.

Figure 12:
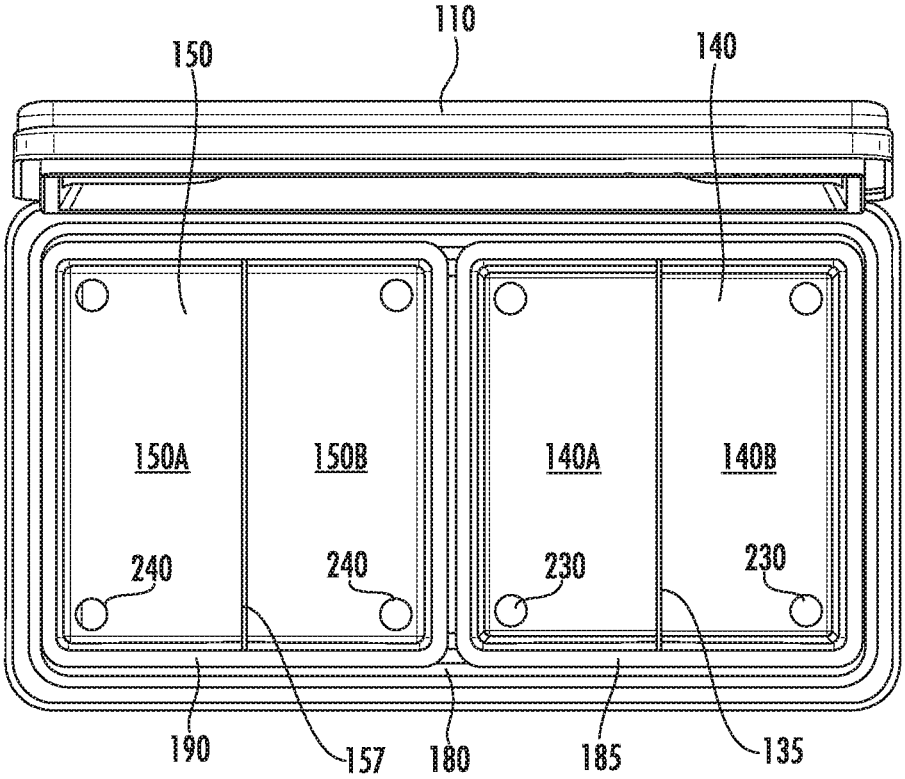
FIG. 12 is a top view of the cooler assembly with the pivoting cover open showing the pair of adjacent internal trays.

FIG. 12 is a top view of the cooler assembly with the pivoting cover open showing the pair of adjacent internal trays. (140, 150). Element 140A may be considered a first storage area. Element 140B may be considered a second storage area. Element 150A may be considered a third storage area. Element 150B may be considered a fourth storage area. Still referring to FIG. 12, the first tray 140 has 4 apertures 230 located proximal the four corners of the bottom of the first tray 140. Additionally, the second tray 150 has 4 apertures 240 located proximal to the four corners of the bottom of the second tray 150. Apertures 240 may be positioned on the side walls, bottom or a combination of both. These apertures may act in a variety of ways depending how the cooler assembly 100 is packed. If ice is placed in the first tray 140 or second tray 150, melt water would fall to the areas below the first tray 140 and second tray 150. The openings 240 may also allow condensation or liquids released by thawing foods to drain. If ice is placed below the first tray 140 and the second tray 150, a greater amount of cooling would take place in the trays (140, 150) due to the openings 230, 240 allowing cool air to pass through the openings 230, 240 from the ice area below the trays to then circulate around the items within the tray. Although difficult to see in FIG. 12, tray 140 has a height of distance D and tray 150 has a height of distance C. These height distances are best seen in FIGS. 9 and 10 respectfully.

Trays have drain holes that allow liquids to drain from the trays to the ice cooler cavity/container below. Liquids from melting ice, condensation, or liquids be released by thawing foods.

It will be understood by the person skilled in the art that terms of orientation such as top, bottom, front, back, left, right, inner, outer, etc. are used herein with reference to the drawings in order to provide a clear and concise description. Such terms are not intended to limit the examples and embodiments in any manner and the scope of the invention as defined herein will encompass other possible orientations of the components as will be perceived by the person skilled in the art.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. An organizer system comprising:

(A) first organizer means defining a first tray having a first height;

(B) first divider means within the first organizer means, the first divider means comprising first handle means for allowing the first organizer means to be removed from an ice cooler;

(C) second organizer means defining a second tray having a second height;

(D) second divider means within the second organizer means, the second divider means comprising second handle means for allowing the second organizer means to be removed from the ice cooler;

(E) insert means for supporting the first organizer means and the second organizer means in the ice cooler, the insert means comprising insert sidewall means;

(F) wherein the at least one insert sidewall means comprises at least one opening through the insert sidewall means and proximal to a bottom of the at least one insert sidewall means, the at least one opening providing a drain through the insert sidewall means for allowing liquid to pass from an inside of the insert means to an outside of the insert means.

2. The organizer system of claim 1 wherein the first organizer means and the second organizer means each comprise lip means by which the respective organizer means may be supported within the ice cooler.

3. An organizer system for use within a body of an ice cooler, the organizer system comprising:

(A) a first organizer tray having a first height; and (B) a second organizer tray having a second height different to the first height and configured to be arranged in side by side relationship with the first organizer tray;

(C) an insert comprising at least one insert sidewall that supports the first organizer tray and the second organizer tray;

(D) wherein each of the first organizer tray and the second organizer tray comprises:

(a) a vertical divider that divides the respective tray into at least two compartments; and (b) a handle formed in the vertical divider;

(E) wherein the at least one insert sidewall comprises at least one opening through the insert sidewall and proximal to a bottom of the at least one insert sidewall, the at least one opening providing a drain through the insert sidewall for allowing liquid to pass from an inside of the insert to an outside of the insert.

4. The organizer system of claim 3 wherein the first organizer tray and the second organizer tray each comprise an outwardly facing lip extending about an outer perimeter of the respective tray by which the respective tray may be supported within an ice cooler by the at least one insert sidewall.

5. A cooler comprising:

(A) a body defining an internal cavity defined by an internal sidewall;

(B) at least one insert sidewall that abuts the internal sidewall of the body;

(C) a first organizer tray having a first height; and (D) a second organizer tray having a second height different to the first height;

(E) wherein at least one of the first organizer tray and the second organizer tray comprises:

(a) a vertical divider that divides the respective tray into at least two compartments; and (b) a handle formed in the vertical divider;

(F) wherein the first organizer tray and the second organizer tray are supported by the at least one insert sidewall in side by side relationship within the internal cavity;

(G) wherein the at least one insert sidewall comprises at least one opening through the insert sidewall and proximal to a bottom of the at least one insert sidewall, the at least one opening providing a drain through the insert sidewall for allowing liquid to pass from an inside of the insert to an outside of the insert and into a drain of the cooler.

6. The cooler of claim 5 wherein the first organizer tray and the second organizer tray are placed in a side by side relationship in the body of the cooler, and wherein the first organizer tray and the second organizer tray define different areas of different heights to place foods and drinks with the cooler.

7. The cooler of the claim 5 wherein each of the first organizer tray and the second organizer tray comprise at least one drain opening.

8. The cooler of claim 5 wherein the first organizer tray and the second organizer tray each comprise an outwardly facing lip extending about an outer perimeter of the respective tray, wherein the respective tray is supported within the body on its respective lip.

9. The cooler of claim 5 wherein the at least one insert sidewall comprises four insert sidewalls that each abut an adjacent internal wall of the cooler.

* * * * *